US005175463A

United States Patent [19]

Farago et al.

[11] Patent Number: 5,175,463

[45] Date of Patent: Dec. 29, 1992

[54] CARBON COMMUTATOR

[75] Inventors: Charles P. Farago, Cleveland; D. Bruce Ramsey, Sr., Brunswick, both of Ohio

[73] Assignee: Kirkwood Industries, Cleveland, Ohio

[21] Appl. No.: 808,942

[22] Filed: Dec. 13, 1991

Related U.S. Application Data

[63] Continuation of Ser. No. 390,202, Aug. 7, 1989, abandoned.

[51] Int. Cl.[5] ..... H01R 39/06

[52] U.S. Cl. ..... 310/237; 29/597

[58] Field of Search ..... 29/597, 598; 310/233, 310/237, 236

[56] References Cited

U.S. PATENT DOCUMENTS

| | | | |
|---|---|---|---|
| 1,811,180 | 6/1931 | Landers | 310/237 |
| 3,538,365 | 11/1970 | Reisnecker | 310/237 |
| 4,349,384 | 9/1982 | Weinert | 29/597 X |
| 4,358,319 | 11/1982 | Yoshida et al. | 29/597 X |
| 4,396,358 | 8/1983 | de Concini | 29/597 X |
| 4,399,383 | 8/1983 | Kamiyama | 29/597 X |
| 4,851,728 | 7/1989 | Doege et al. | 310/233 |

OTHER PUBLICATIONS

German Publication No. DE 31 50 505 A1 (English translation), Dec. 21, 1981.

*Primary Examiner*—Carl E. Hall

*Attorney, Agent, or Firm*—Calfee Halter & Griswold

[57] ABSTRACT

A fuel pump and the method for making the fuel pump designed for operation in an environment of a hydrocarbon fuel having a significant portion of oxygen-containing moieties are disclosed. The pump consists of a body, a shaft, a commutator, and brushes in contact with the commutator; the method of making the commutator comprises the steps of affixing a formed carbon article to a suitable substrate, machining the article to a commutator, and cutting slots into the commutator. In one embodiment, the method includes forming the carbon article directly on the substrate prior to the machining steps.

11 Claims, 1 Drawing Sheet

CARBON COMMUTATOR

This is a continuation of copending application Ser. No. 07/390,202 filed on Aug. 7, 1989 now abondoned.

BACKGROUND OF THE INVENTION

1. Field of the Invention

The present invention is in the field of making commutators for electrical motors. More particularly, this invention is in the field of carbon commutators for electric fuel pumps operating in an environment of single- or multiple-component hydrocarbon fuels with a significant portion of oxygen-containing moieties.

2. Description of the Prior Art

Electric fuel pumps have long been used in automotive applications to effect movement of liquid fuels from the storage means to the engine. Early pumps were simply the application of electrical energy to a mechanical pump; later pumps incorporated the motor and pump mechanism, but maintained the isolation of the fuel from the motor.

While mechanical pumps generally are located near the engine, and serve primarily as suction devices, electric fuel pumps function best as pressure pumps, and are most often located very near the fuel tank. Present technology often provides a fuel pump submerged inside the fuel tank, with the electric motor operating in the liquid fuel itself, thus eliminating the need for shaft seals or any other mode of isolation of the motor from the environment.

Electric fuel pumps operating in a substantially pure hydrocarbon environment, i.e., gasoline or diesel fuel, are known in the art, and have acceptable operating lives. In U.S. Pat. No. 4,399,383, Kamiyama discloses a gasoline-resistant commutator having a silver current-carrying medium plated or clad onto a copper substrate to minimize wear on the commutator surface by the motor brushes working submerged in a gasoline tank. The Kamiyama patent, however, is restricted by its terms to operation in an ordinary gasoline environment, and its efficacy in other media is unpredictable.

In more recent times, the advent of mixed fuels with a significant portion of oxygen-containing moieties, e.g., methanol or ethanol, added to the base hydrocarbon, has lead to problems with the rapid wear of the commutators of conventional submerged electric fuel pumps. It has been determined that the Kamiyama device is only moderately suitable in such other types of environments containing significant amounts of hydroxylic components. While not wishing to be bound by theoretical considerations set forth herein, it is believed that copper and other metals, under the influence of highly localized electrical fields such as those encountered with interface sparking or current transfer, react with the hydroxyl group of an alcoholic fuel moiety or water dissolved therein, thus producing the respective metal salt which is then carried into the fuel stream. Continuously repeated reactions of this sort drive the equilibrium of the equation of that reaction to the right, causing a comparatively rapid removal of the metal until the commutator surface is worn beyond utility, leading to unacceptably short service life of the fuel pump.

While submerged fuel pumps have been used with acceptable service lives in environments consisting essentially of gasoline with only minor amounts of additives such as octane enhancers, anti-gum agents and the like, the increasing occurrence of oxygen-containing fuels, specifically alcohols, has lead to high rates of wear on copper commutators. With a continuing emphasis on matters of concern for the environment, there is a substantial likelihood that fuels consisting primarily of gasoline may be replaced entirely or in part by oxgeyn-containing liquid fuels such as, e.g., methanol and ethanol. Under these circumstances, submerged fuel pumps with metallic, e.g., copper commutators will be unsatisfactory.

SUMMARY OF THE INVENTION

The present invention is the fuel pump and the method for making such a fuel pump for operation in an environment of a hydrocarbon fuel having a significant portion of oxygen-containing moieties, the pump consisting of a body, a shaft, a commutator, and brushes in contact with the commutator, where the method of making the commutator comprises the steps of affixing a formed carbon article to a substrate, machining the article to a commutator, and cutting slots into the commutator. In one embodiment, the method includes forming the carbon article directly on the substrate prior to the machining steps.

BREIF DESCRIPTION OF THE DRAWINGS

DESCRIPTION OF THE PREFERRED EMBODIMENTS

A preferred embodiment of the present invention is the method of making a fuel pump for operation in an environment of a hydrocarbon fuel having a significant portion of oxygen-containing moieties, wherein the pump consists of a body, a shaft, a commutator, and brushes in contact with the commutator, where the commutator is formed of carbon, the method comprising affixing a carbon article to a substrate, machining the article to a commutator, and cutting slots into the commutator. The most-preferred embodiment is the method of making the commutator which comprises affixing a formed carbon article to a substrate, machining the article to a commutator, cutting slots into the commutator, and thereafter electrically connecting the commutator to the armature of the finished fuel-pump motor.

As used herein, the term "significant," as applied to the oxygen moiety of a hydrocarbon fuel, comprehends fuels with about ten percent or greater oxygen-containing constituents such as methanol, ethanol, propyl alcohols, keytones and the like.

Figure 1:
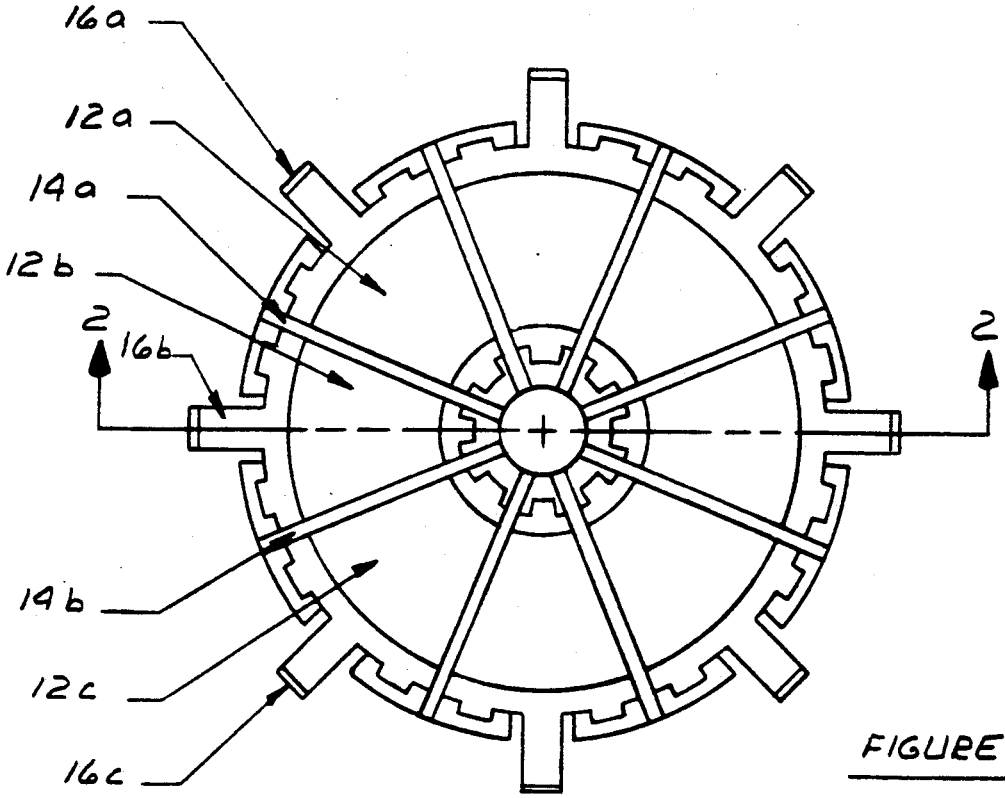
FIG. 1 is plan view of the article formed by the method of the invention, showing a flat commutator.

Turning now to FIG. 1, the article formed by the method of the preferred embodiment of the invention is shown generally at 10. Commutator 12 comprises a plurality of segments 12*a*, 12*b* and 12*c*, separated by radial slots 14*a*, 14*b*, etc. Tangs 16*a*, 16*b*, etc., provide a current path for the current-carrying windings of the finished motor.

Figure 2:
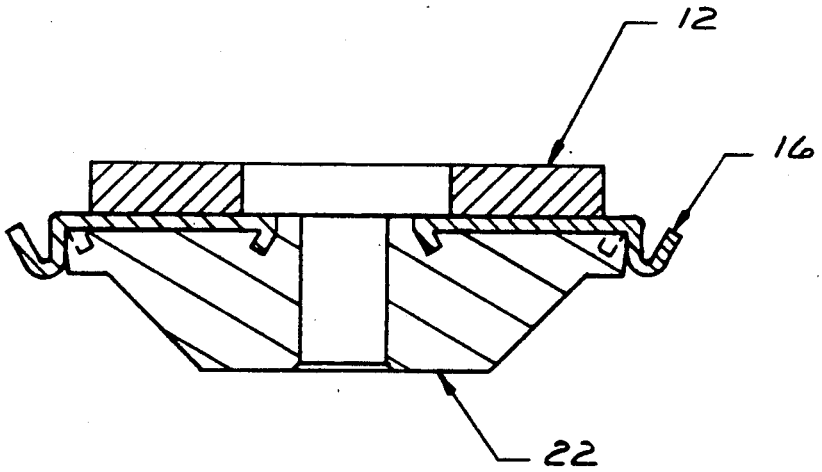
FIG. 2 is a sectional view taken along lines 2—2 of FIG. 1.

In FIG. 2, which is a sectional view taken along lines 2—2 in FIG. 1, commutator 12 is shown affixed to commutator substrate 22 in electrical contact with tangs 16. Substrate plate portions 26 are integral with tangs 16. Shaft 24 provides transmission of force to the fuel pump (not shown).

In one embodiment of the method of the present invention, fine-grain electrical-grade carbon is molded into a toroidal shape with coplanar surfaces, and a layer or film of a first conductive material such as, e.g., nickel is plated onto one of the planar surfaces thereof. A second conductive layer or film is plated onto the first conductive material, and an electrically conductive material having a relatively low melting point is deposited onto the second layer. The treated surface of the torus is then placed in juxtaposition with the planar surface of the substrate plate portions 26 of commutator substrate 22, and the items heated to cause the low-melting-point material to form an electrically conductive bond therebetween. Substrate plate portions 26 are substantially thinner than the teaching ogf the prior art, being from about 0.15 to 0.75 millimeter (mm), and preferably from about 0.3 to about 0.6 mm in thickness. The thickness of similar devices of the prior art is in the range of about 1.5 to 2.0 mm.

The first conductive material is preferably nickel, but can be copper or other appropriately conductive material such as e.g., gold, silver, copper or conductive alloy. The second conductive film can be the same as or different from the first, and is preferably copper, but can also be gold, silver, cadmium, chromium, or other conductive material or alloy. The low-melting conductive material is preferably a multi-component solder alloy containing primarily tin and antimony, bismuth or other relatively low-melting metal, and melting at a temperature low enough to avoid thermal damage to the device during the steps of its formation, but high enough to avoid loss of mechanical strength during such steps or the operation of the finished fuel-pump motor. Other alloys can also be used, including, e.g., brass, german silver, and gold, silver and copper alloys, to bond the commutator metallically to the substrate.

The commutator is then slotted through to isolate electrically each portion 12*a*, 12*b*, etc., from the other portions. Following the step of slotting the commutator, appropriate wire windings are applied to tangs 16, and the motor is completed in accordance with techniques known to those skilled the the art.

In another embodiment of the method of this invention, electrical-grade carbon is pressed directly onto the armature, and the rough shape is machined as required to provide contact surfaces and current paths. In this embodiment, the substrate portion can be of any configuration required, commensurate with proper operation of the finished motor. Thus, the commutator or substrate, or both, can be, without limitation herein, planer, cylindrical, toroidal or conical.

In yet another embodiment of the present invention, a preformed rough commutator is treated appropriately to provide at least one planar surface parallel with the surface provided for electrical contact, and the planar surface then adhesively fastened to the substrate to provide an electro-mechanical bond. In this embodiment, the adhesive used must have conductivity adequate to transmit the electrical current required for proper motor performance. The adhesive may conveniently have particles carried therein.

The completed motor made in accordance with the foregoing method is assembled into a fuel pump and operated while immersed in a hydrocarbon fuel containing a significant portion of oxygen-containing moieties, and demonstrates a clear improvement in performance as compared with submerged fuel pumps of the piror art.

Modifications, changes and improvements to the preferred forms of the invention herein described, disclosed and illustrated may occur to those skilled in the art who come to understand the principles and precepts thereof. Accordingly, the scope of the patent to be issued hereon should not be limited to the particular embodiments of the invention set forth herein, but rather should be limited only by the advance by which the invention has promoted the art.

What is claimed is:

1. A commutator comprising: a planar substrate including a series of current-carrying regions, a corresponding series of commutator segments, and a conductive bonding layer bonding each of said commutator segments to said substrate; each of said commutator segments comprising:

a carbon base having a brush-contacting first surface and a second opposite surface which is substantially parallel to said first surface; and a conductive plating positioned between said second surface of said carbon base and said bonding layer.

2. A commutator as set forth in claim 1 wherein said conductive plating comprises a first conductive layer substantially covering said second surface of said carbon base and a second conductive layer substantially covering said first conductive layer and being positioned between said bonding layer and said first conductive layer.

3. A commutator as set forth in claim 2 wherein said first conductive layer is comprised of a material selected from a group consisting of nickel, copper, gold, silver, or conductive alloys thereof.

4. A commutator as set forth in claim 3 wherein said second conductive layer is made of the same material as said first conductive layer.

5. A commutator as set forth in claim 3 wherein said second conductive layer is made of a different material than said first conductive layer.

6. A commutator as set forth in claim 2 wherein said second conductive layer is made of a material selected from a group consisting of copper, gold, silver, copper or conductive alloy.

7. A commutator as set forth in claim 2 wherein said first conductive layer is made of nickel and wherein said second conductive layer is made of copper.

8. A commutator as set forth in claim 2 wherein said current-carrying members each comprise a conductive substrate plate portion positioned adjacent to said second conductive bonding layer.

9. A commutator as set forth in claim 1 wherein said conductive bonding layer comprises a heat-forming bonding material.

10. A commutator as set forth in claim 9 wherein said heat-forming bonding material is a low temperature melting solder containing tin and antimony.

11. A commutator as set forth in claim 1 wherein said conductive bonding layers comprises an electrically conductive adhesive.

* * * * *